US006539573B1

(12) United States Patent
Caccavella

(10) Patent No.: US 6,539,573 B1
(45) Date of Patent: Apr. 1, 2003

(54) JETNET

(76) Inventor: Michael A. Caccavella, 9300 SW. 2nd St., Boca Raton, FL (US) 33428-4512

( * ) Notice: Subject to any disclaimer, the term of this patent is extended or adjusted under 35 U.S.C. 154(b) by 0 days.

(21) Appl. No.: 09/286,331

(22) Filed: Apr. 5, 1999

(51) Int. Cl.[7] ..... E04H 4/16
(52) U.S. Cl. ..... 15/1.7
(58) Field of Search ..... 15/1.7

(56) References Cited

U.S. PATENT DOCUMENTS

| | | | | | |
|---|---|---|---|---|---|
| 4,356,582 | A | * | 11/1982 | Stephenson | 15/1.7 |
| 4,618,420 | A | * | 10/1986 | Alanis | 15/1.7 |
| 4,651,376 | A | * | 3/1987 | Ford | 15/1.7 |
| 5,454,940 | A | * | 10/1995 | Lakotish | 15/1.7 |
| 5,542,141 | A | * | 8/1996 | Albright | 15/1.7 |
| 5,768,734 | A | * | 6/1998 | Dietrich | 15/1.7 |
| 5,842,243 | A | * | 12/1998 | Horvath | 15/1.7 |
| 5,863,425 | A | * | 1/1999 | Herley | 15/1.7 |
| 5,893,188 | A | * | 4/1999 | Campbell | 15/1.7 |
| 5,985,156 | A | * | 11/1999 | Henkin | 15/1.7 |

* cited by examiner

*Primary Examiner*—Randall E. Chin

(57) ABSTRACT

The JetNet has a slightly flared bell shaped plastic resin head with wheels at the bottom, and an electric boat motor inside. Attached to a bracket on the head, a removable pool pole is used to move the machine around under the water: A mesh bag is secured to the top of the head with a bungie cord and rubber lip. A cord goes from the boat motor inside the head, through plastic floats to keep it out of the way of the machine by floating it on top of the water, and plugs into the JetPac. The JetPac is mounted on the outside of a milk crate. The JetPac is a sealed metal box containing an electric transformer which converts 110 volt AC power to 12 volt DC power, an on/off switch, a male-female connector, and a power plug for a standard extension cord. The extension cord is used to power the machine simply by plugging it into the power plug on the bottom of the JetPac. The machine is completely Portable and is very lightweight. The head is placed upside down inside the milk crate along with the rolled up cord and everything is ready for transport to another location. When the head is lowered into the swimming pool, the boat motor creates a suction forcing water through the head and then through the mesh bag, which traps dirt and debris, leaving the water clean as it flows through. The mesh bag is easily emptied by stretching the bungie cord at its opening and removing it. The JetPac provides a male connector for the extension cord, a convenient on/off switch, and a male-female connector for easily disconnecting the head. The head is placed inverted into the milk crate for easy transport. It is a unique machine as it is lightweight, portable, and utilizes 110 AC power which is converted to DC power by the JetPac.

1 Claim, 5 Drawing Sheets

JETNET

CROSS-REFERENCE TO RELATED APPLICATION

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION

1. Field of the Invention

This invention relates to the cleaning of dirt and debris from swimming pools, fountains, and spas.

2. Description of the Related Art

There are a variety of devices and methods of removing dirt and debris from swimming pools, fountains, and spas. This invention differs specifically from all prior art as it is powered by JetPac which converts 110 volt AC power to 12 volt DC power.

BRIEF SUMMARY OF THE INVENTION

The bag on this invention can be removed, emptied, and replaced unlike Horvath's (U.S. Pat. No. 5,842,243) which has a disposable filter. This invention has a slightly-flared bell shaped head unlike other pool cleaners, such as Dietrich's (U.S. Pat. No. 5,768,734), which has a relatively narrow and elongated head, as well as Horvath's (U.S. Pat. No. 5,842,243), Albright's (U.S. Pat. No. 5,542,141), and Ford's (U.S. Pat. No. 4,651,376), which all have small openings. The JetNet's unique wheel position allows it to be very easily maneuvered, unlike Albright's machine (U.S. Pat. No. 5,542,141).

Another great advantage to this invention is that unlike Horvath's (U.S. Pat. No. 5,842,243) and Ford's (U.S. Pat. No. 4,651,376), this invention is powered by 110 AC power which is converted to DC power by the JetPac. This makes JetNet a lightweight and portable cleaning machine that does not require the use of a hand-truck or cart for transportation. While Dietrich (U.S. Pat. No. 5,768,734) does not indicate his invention's source of power and only refers to a "12 volt electric motor" with an "electrical conductor" the mere use of the word conductor indicates that there is no power conversion going on, only conducting. He makes no specific mention of using 110 AC power, no mention of any transformer, no mention of any conversion of power, further indicating his invention is only capable of conducting power to the motor. This invention differs from Dietrich's (U.S. Pat. No. 5,768,734) in that it utilizes a 12 volt DC motor powered by 110 volt AC power which is converted to 12 volt DC power via JetPac which contains a UL approved power transformer.

DETAILED DESCRIPTION OF THE INVENTION

Figure 1:
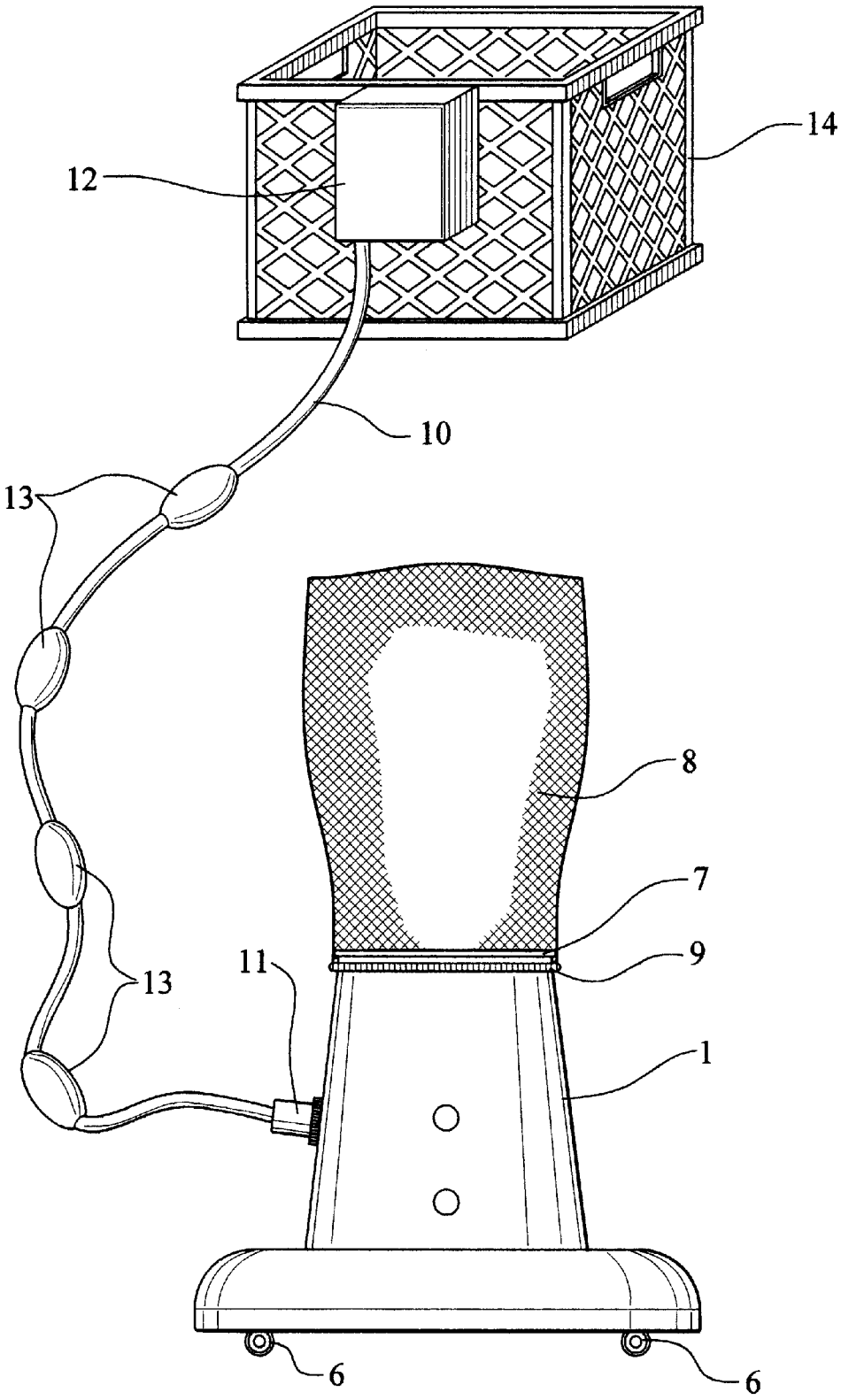
FIG. 1: Full view of JetNet stretched out, showing the head, power cords, crate, and JetPac.
Figure 2:
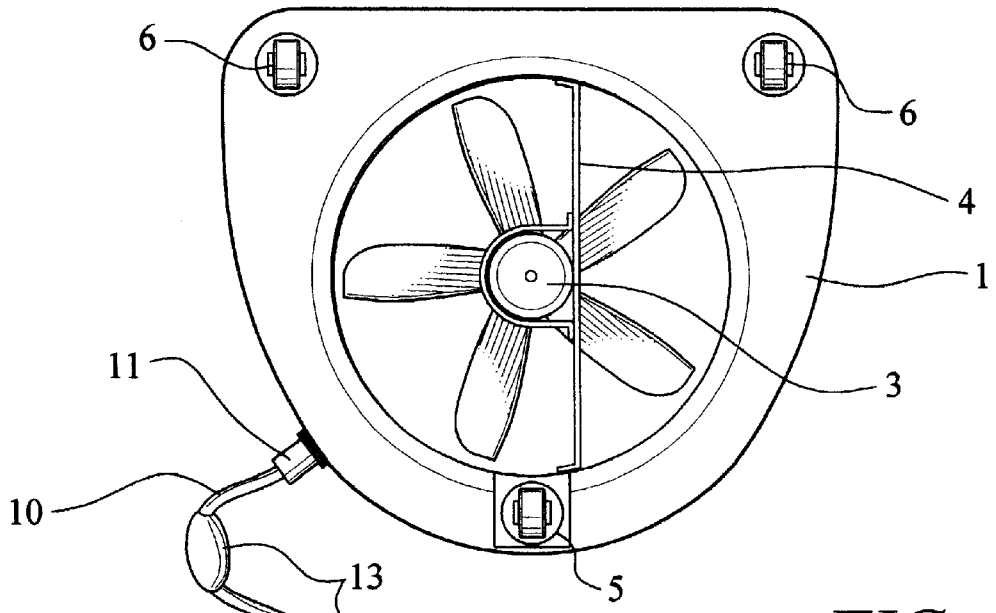
FIG. 2: View from bottom of shell showing boat motor which propels water through the shell.
Figure 3:
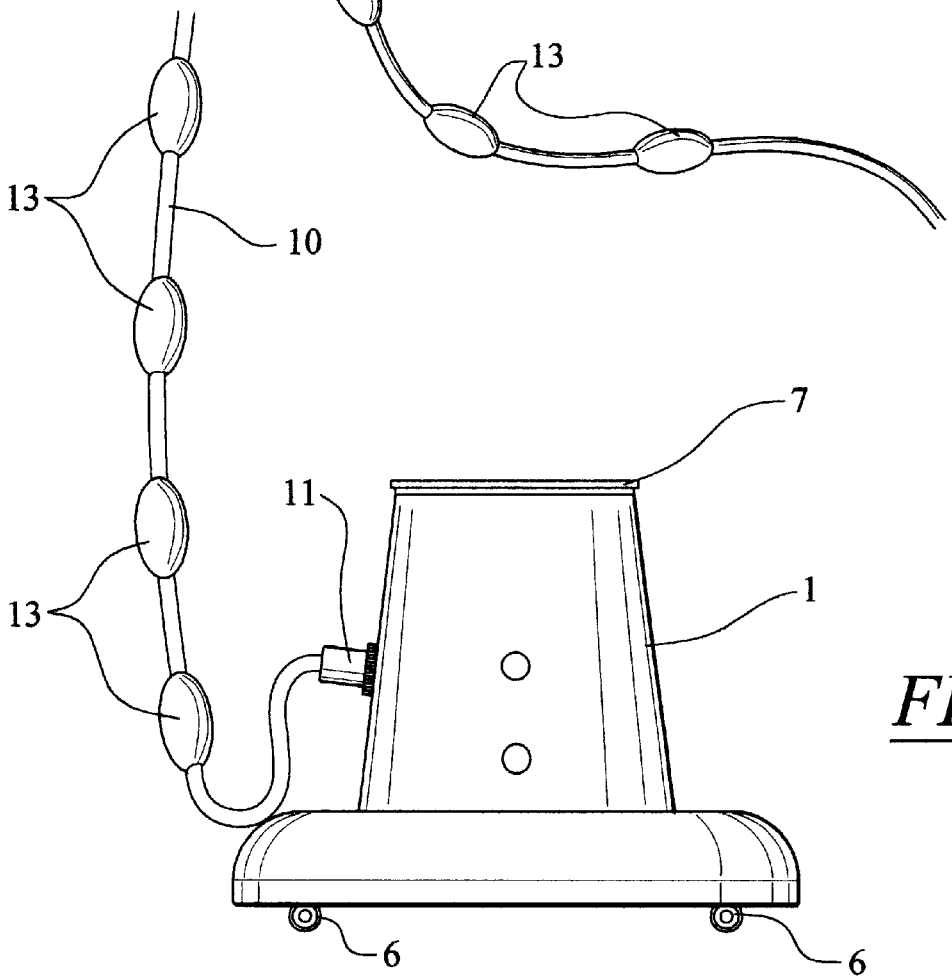
FIG. 3: View from front of head without bag.
Figure 4:
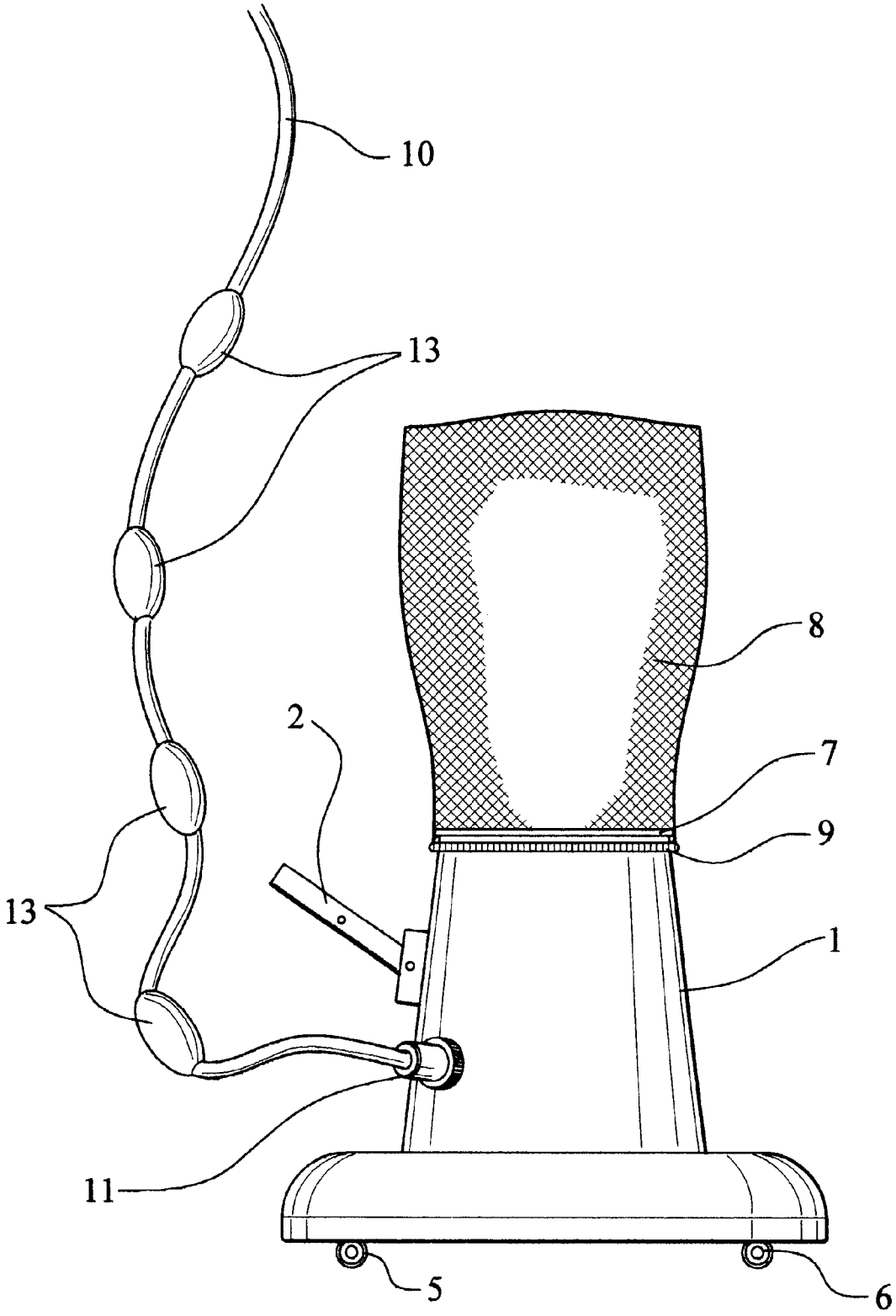
FIG. 4: View from side of head with bag.
Figure 5:
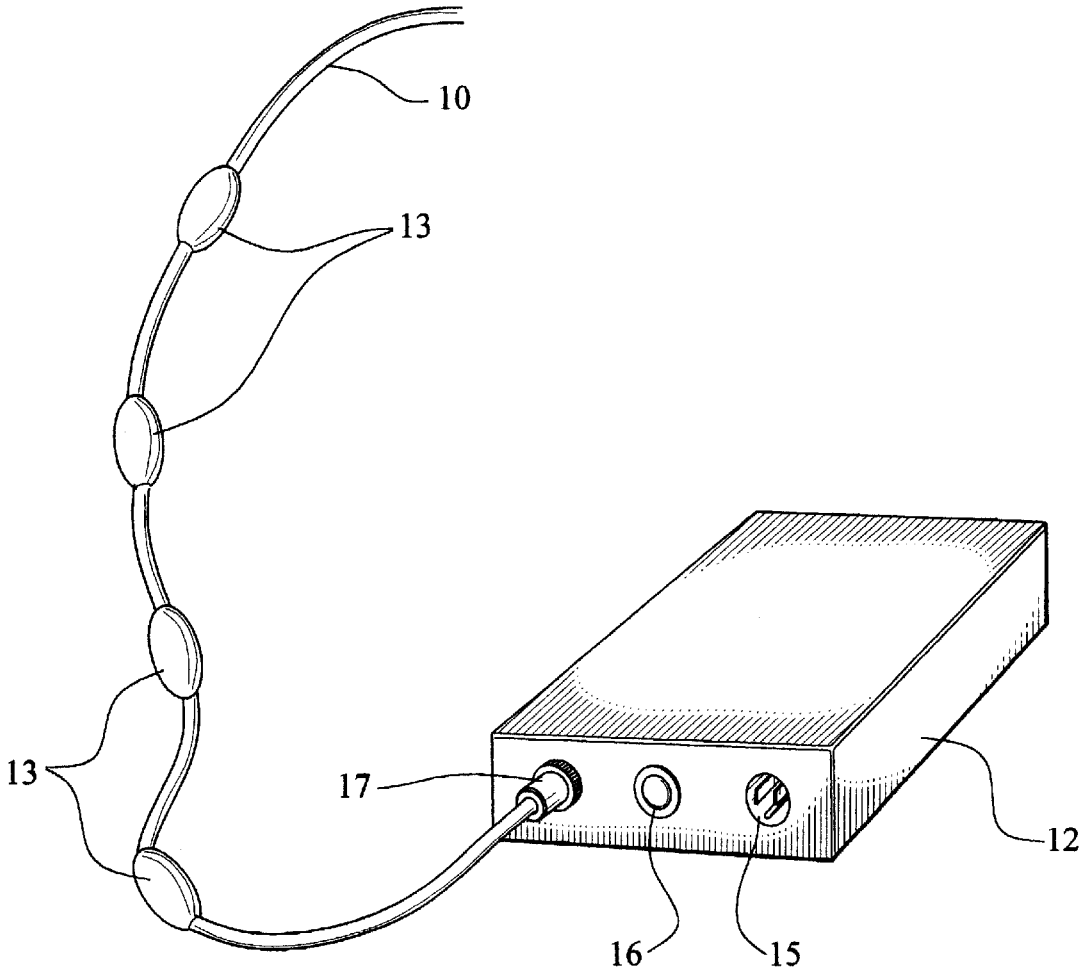
FIG. 5: View from bottom of JetPac.
Figure 6:
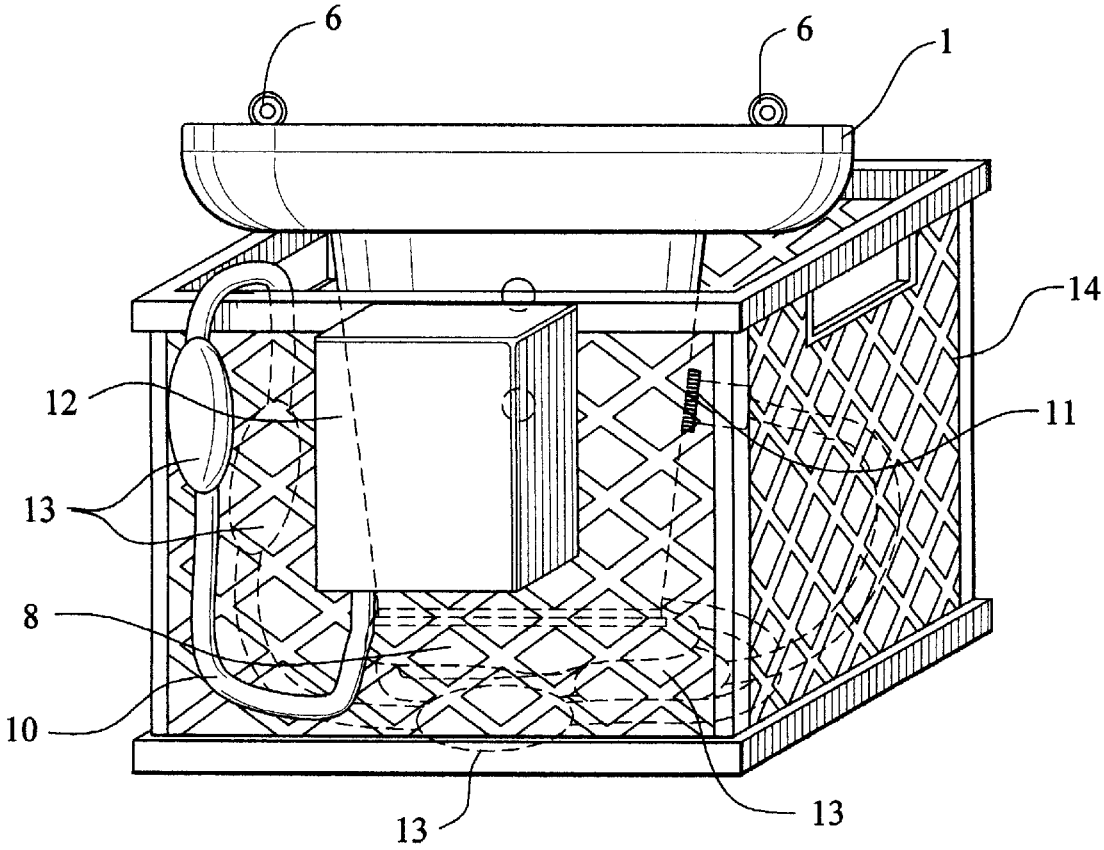
FIG. 6: View of JetNet packed for transport.

The JetNet head (1) is formed of plastic resin in the shape of a bell with slightly flared edges at the bottom, as can be seen in FIGS. 3 and 4. The top of the head (1) is 24¾" in circumference. It is 30½" in circumference just above the flair which is 2½" tall and 52" in circumference. The flared bottom is round at the back and squared in the front. The entire head (1) is 13" tall. The head (1) has a standard pool pole bracket (2) attached at the back with metal screws, as can be seen in FIG. 4, so a removable standard pool pole can be used to move the machine around under the water. Inside the head (1), a 12 volt DC 1 horse power electric boat motor (3) is mounted on metal brackets (4) using metal screws, as can be seen in FIG. 5. Plastic wheels, each 2" in diameter and 1½" wide, are fixed into the flared bottom of the head (1) with plastic brackets and metal screws, two front wheels (6) and one back wheel (5), as can be seen in FIG. 5. The rear wheel (5) turns 360° and the front two wheels (6) are fixed straight. Attached around the top of the head (1), ¼" below the top of the head (1), is a rubber lip (7), as can be seen in FIG. 3. This rubber lip (7), which is ⅞" wide, holds a mesh bag (8) in place, as can be seen in FIG. 4. The mesh bag (8), which is 14¼" wide by 24" high, has a bungie cord (9) inside its opening to allow the bag's opening to be kept tightened when on the head and stretched loose so the bag can be easily removed for emptying. The bungie cord (9) is slipped over the rubber lip (7) on the head, which holds the bag on the head when the JetNet is in use. A 40' plastic-coated marine rated power cord (10) goes from the boat motor (3) inside the head (1), through an epoxy-sealed water-tight connector (11) at the rear-side corner, and connects to the bottom of the JetPac (12) via a male-female water-tight boat connector (17). The boat connector (17) allows the head (1) to be easily disconnected from the JetPac (12). The cord (10) runs through four plastic floats (13), as can be seen in FIG. 1. The plastic floats (13), each 5¼" long and 9" in circumference at the center, keep the cord (10) out of the way of the machine's head (1) by floating it on top of the water. The JetPac (12) is mounted on the outside of a standard milk crate (14), as can be seen in FIGS. 1 and 6. The JetPac (12) is a sealed metal box measuring 8 ½" wide by 10" tall by 3¾" deep containing a weatherproof UL approved power transformer, which converts 110 volt AC power to 12 volt DC power The JetPac (12) has a male power plug (15) located on its bottom, for use with a standard extension cord, as can be seen in FIG. 5. The JetPac (12) also has an on/off switch (16) located on the bottom, as can be seen in FIG. 5. A standard extension cord is used to power the machine simply by plugging it into the power plug (15) at the bottom of the JetPac (12). The machine is completely portable and is very lightweight. The head (1) is placed upside down inside the milk crate (14) along with the rolled up cord (10), as can be seen in FIG. 6, and everything is ready for transport to another location.

A standard extension cord is plugged into the male power plug (15) at the bottom of the JetPac (12), which converts 110 volt AC to 12 volt DC, providing power to the JetNet. The JetNet is turned on using the on/off switch (16) located at the bottom of the JetPac (12). A standard pool pole is connected onto the pole bracket (2) on the back of the head (1). The head (1) is lowered into the swimming pool. The boat motor (3) creates a suction forcing water through the head (1) and then through the mesh bag (8), which traps dirt and debris, leaving the water clean as it flows through. Once the pool is clean, the JetNet is removed from the swimming pool and turned off. The mesh bag (8) is easily emptied by stretching the bungie cord (9) at the opening of the mesh bag (8), allowing it to be removed from the head (1) and emptied. The head (1) is placed inverted into the milk crate (14) for easy transport.

What is claimed is:

1. A portable cleaning assembly for removing dirt and debris from swimming pools, fountains, spas, and like bodies of water, said assembly comprising:

a head formed of plastic resin in the shape of a bell with slightly flared edges at the bottom, said flared bottom being round at the back and squared in the front;

a bracket mounted at the back of said head, said bracket for attaching a removable pole for moving said head under water;

a combination of plastic wheels attached to the flared bottom of said head, said wheels consisting of two fixed front wheels and one 360° rotating rear wheel;

a removable mesh bag at the top of said head, said bag for trapping dirt and debris;

a rubber lip mounted around the top of said head for attaching said bag;

a bungie cord inside the opening of said bag, said bungle cord for securing said bag to said head after slipping said bungie cord over said lip;

a 12 volt DC 1 horse power electric motor mounted inside said head, said motor having a propeller for forcing water through said head and said bag;

a plastic-coated power cord attached to said motor, said power cord running through four plastic floats for suspending said cord above said head;

a plastic crate for storing and transporting said head;

a sealed metal box mounted on the side of said crate, said metal box containing an on/off switch, a male-female water-tight connector for connecting and disconnecting said power cord, and a male power plug for connecting to 110 volt AC power;

a power transformer/converter mounted inside said box and connected to said male-female connector, said transformer converting 110 volt AC power to 12 volt DC power.

* * * * *